US010974278B2

(12) United States Patent
Knorr

(10) Patent No.: US 10,974,278 B2
(45) Date of Patent: Apr. 13, 2021

(54) VIBRATION ELEMENT WITH DECOUPLED COMPONENT

(71) Applicant: HERRMANN ULTRASCHALLTECHNIK GMBH & CO. KG, Karlsbad (DE)

(72) Inventor: Michael Knorr, Ettlingen (DE)

(73) Assignee: HERRMANN ULTRASCHALLTECHNIK GMBH & CO. KG, Karlsbad (DE)

( * ) Notice: Subject to any disclaimer, the term of this patent is extended or adjusted under 35 U.S.C. 154(b) by 155 days.

(21) Appl. No.: 15/315,399

(22) PCT Filed: Aug. 7, 2015

(86) PCT No.: PCT/EP2015/068259
§ 371 (c)(1),
(2) Date: Dec. 1, 2016

(87) PCT Pub. No.: WO2016/023823
PCT Pub. Date: Feb. 18, 2016

(65) Prior Publication Data

US 2017/0197231 A1 Jul. 13, 2017

(30) Foreign Application Priority Data

Aug. 14, 2014 (DE) ..... 10 2014 111 661.5

(51) Int. Cl.
*B06B 1/06* (2006.01)
*G10K 11/00* (2006.01)

(52) U.S. Cl.
CPC ..... *B06B 1/06* (2013.01); *G10K 11/002* (2013.01)

(58) Field of Classification Search
CPC ..... B06B 1/06; G10K 11/002
(Continued)

(56) References Cited

U.S. PATENT DOCUMENTS 3,823,717 A 7/1974 Pohlman
3,824,138 A 7/1974 Karobath
(Continued)

FOREIGN PATENT DOCUMENTS

CH 390595 B 4/1965
CH 537267 5/1973
(Continued)

OTHER PUBLICATIONS

Nora Linder, International Bureau of the World Intellectual Property Organization, PCT/EP2015/068259, International Preliminary Report on Patentability, dated Feb. 14, 2017.
(Continued)

*Primary Examiner* — Derek J Rosenau
(74) *Attorney, Agent, or Firm* — Paul & Paul

(57) ABSTRACT

The present invention concerns a vibration element like for example a sonotrode with a component fixed thereto. To provide a vibration element having a component fixed thereto, which is simple to manufacture, has a long service life and in addition prevents detachment of the component from the sonotrode, it is proposed according to the invention that the vibration element has a bore and the component has a fixing portion fitted in the bore, wherein arranged between the fixing portion and the bore is an elastic element which is either elastically deformed, and more specifically preferably parallel to the bore axis, or is arranged at least partially within a recess provided in the inside surface of the bore in such a way that the component can be removed from the bore only by elastic deformation of the elastic element.

20 Claims, 6 Drawing Sheets

(58) Field of Classification Search
USPC ..... 310/326, 328
See application file for complete search history.

(56) References Cited

U.S. PATENT DOCUMENTS

| | | | | |
|---|---|---|---|---|
| 4,560,189 | A | 12/1985 | Lang | |
| 4,988,334 | A | 1/1991 | Hornlein | |
| 5,211,625 | A | 5/1993 | Sakurai | |
| 5,816,626 | A | 10/1998 | Anderson et al. | |
| 6,637,677 | B1 * | 10/2003 | Ruehle | F02M 51/0603 123/478 |
| 7,959,054 | B2 | 6/2011 | Konieczka | |
| 2002/0010486 | A1 * | 1/2002 | Hirt | A61B 17/22012 606/169 |
| 2003/0066863 | A1 | 4/2003 | Skogsmo | |
| 2004/0170944 | A1 * | 9/2004 | Huguenin | A61C 17/20 433/119 |
| 2007/0251978 | A1 | 11/2007 | Konieczka | |
| 2013/0240152 | A1 * | 9/2013 | Regan | B23K 20/106 156/580.1 |

FOREIGN PATENT DOCUMENTS

| | | | |
|---|---|---|---|
| CN | 1511015 | A | 7/2004 |
| CN | 201672202 | U | 12/2010 |
| CN | 202371347 | U | 8/2012 |
| DE | 2219790 | B | 10/1973 |
| DE | 3246768 | C1 | 1/1989 |
| DE | 3817921 | A1 | 11/1989 |
| DE | 4109000 | A1 | 9/1991 |
| DE | 20219407 | U1 | 3/2003 |
| EP | 0778437 | A1 | 11/1997 |
| EP | 1849583 | A2 | 10/2007 |
| JP | 08-195998 | A | 7/1996 |
| JP | 08-215616 | A | 8/1996 |
| JP | 2007-32754 | A | 2/2007 |
| JP | 2012-112397 | A | 6/2012 |
| JP | 2013-136130 | A | 7/2013 |

OTHER PUBLICATIONS

Office Action, dated Feb. 6, 2019, Japanese Application No. JP 2016-575668 (and English Translation).

Chen Shan, China National Intellectual Property Administration, Office Action, Chinese Application No. 201580035011.6, dated Dec. 17, 2020 (and English Translation of Office Action).

* cited by examiner

VIBRATION ELEMENT WITH DECOUPLED COMPONENT

CROSS-REFERENCE TO RELATED APPLICATION

This application is a 371 national stage application of International Application PCT/EP2015/068259, filed Aug. 7, 2015, and claims the priority of German Application No. 10 2014 111 661.5, filed on Aug. 14, 2014.

The present invention concerns a vibration element like for example a sonotrode with a component fixed thereto.

The ultrasonic processing of materials involves using an ultrasonic vibration unit generally comprising a converter which converts an electrical ac voltage into a mechanical excitation, optionally an amplitude transformer and a sonotrode. The entire ultrasonic vibration unit is then acted upon with a high-frequency ac voltage so that the ultrasonic vibration unit vibrates, with a standing wave being formed within the sonotrode.

In the ideal situation all components of the ultrasonic vibration unit are matched to each other in such a way that the entire ultrasonic vibration unit has a natural frequency in the ultrasound range, with which the ultrasonic vibration unit can then be excited. Any further element which comes into contact with the ultrasonic vibration unit or which is even fixed thereto can impair the vibration properties of the ultrasonic vibration unit. Therefore in general no additional components are fitted to the ultrasonic vibration unit. In addition a high level of expenditure and complication is involved in regard to the holding means of the ultrasonic vibration unit in order to ensure that the holding means influences the vibration behaviour of the ultrasonic vibration unit as little as possible.

In many cases however it is necessary for components to be fixed to a vibration element of the ultrasonic vibration unit. For example the sonotrode can have an annular sealing surface which during the processing operation comes into contact with the material to be processed. It can then be advantageous if fluid is supplied within the annular sealing surface or if a hold-down means is provided. In that case the sonotrode has a cavity into which fluid, for example air, has to be fed during the processing operation.

FIG. 1 shows an embodiment of the state of the art. Here a sonotrode 1 has a centrally extending cavity 2. In order to feed air into that cavity a bore 3 has been provided in the sonotrode in the radial direction, while fitted into the bore 3 is a hose 4, by way of which fluid can be introduced into the cavity 2.

As however in operation the sonotrode 1 vibrates with an ultrasonic vibration that results in unwanted ultrasonic working of the tube 4 so that the tube 4 has only a limited service life. Even if the bore 3 is so arranged that it is substantially in the region of a vibration node, then in practice the service life of such hose connections is limited so that the hose 4 has to be relatively frequently replaced. In addition there is the danger that the hose 4 comes loose during operation of the sonotrode.

FIG. 2 shows a second embodiment of the state of the art in which there is provided a suction ring 5 in order to ensure connection of a hose to the cavity 2. The sonotrode shown is of a circular cross-section so that the suction ring 5 which is of a sleeve-like structure can be arranged around the sonotrode by means of O-rings 6. The O-rings 6 serve to seal off an annular space formed by the annular recess 7 in the suction ring 5, in the axial direction, that is to say upwardly and downwardly in the Figure. The suction ring 5 has a radially extending bore in which there is arranged a connecting portion 8 on which the air hose can be fixed.

The suction ring 5 is admittedly completely decoupled from the vibrating part but it has to be exactly matched to the sonotrode.

This structure is relatively complicated and expensive and is exclusively suited to round sonotrodes. The arrangement of completely surrounding the sonotrode also requires an increased amount of space so that this sonotrode cannot be used for all applications.

Taking the described state of the art as the basic starting point therefore the object of the present invention is to provide a vibration element having a component fixed thereto, which is simple to manufacture, has a long service life and also prevents detachment of the component from the sonotrode.

According to the invention that is achieved in that the vibration element has a bore and the component has a fixing portion fitted in the bore, wherein arranged between the fixing portion and the bore is an elastic element which is either elastically deformed or is arranged at least partially within a recess provided in the inside surface of the bore in such a way that the component can be removed from the bore only by elastic deformation of the elastic element.

The measure described can for example also be subsequently implemented in existing sonotrodes. It is only necessary for a suitable bore to be provided in the sonotrode. The fixing portion of a component can then be fitted into the bore, with the elastic element being arranged between the fixing portion on the one hand and the inside walls of the bore on the other hand. To prevent a relative movement of the fixing portion with respect to the bore the elastic element is such that in the inserted condition it is either elastically deformed or it is at least partially arranged within a recess in the inside surface of the bore in such a way that the component can be removed from the bore only by elastic deformation of the elastic element.

In the simplest case the bore is of a circular cross-section. In principle however other cross-sections would also be conceivable, like for example a square cross-section.

In the same manner, in a preferred embodiment it is provided that the fixing portion has a circular cross-section. It will be appreciated however that the fixing portion also does not necessarily have to be of a circular cross-section but for example can be of a square cross-section. In addition it is also not necessary that the bore and the fixing portion must be of a mutually corresponding cross-section. It will be noted however that it is necessary for the elastic element to be matched both to the fixing portion and also to the bore.

In a preferred embodiment the elastic element is adapted to completely surround the fixing portion. For the situation where the bore is of a circular cross-section and the fixing portion is of a circular cross-section the elastic element can be of a ring-shaped or sleeve-shaped configuration so that it can be pushed over the outside surface of the fixing portion and can be introduced together with same into the bore.

To make the connection between the vibration element and the component as tilting-resistant as possible a preferred embodiment provides that at least two elastic elements are arranged between the fixing portion and the bore, wherein preferably the two elastic elements are axially spaced from each other. In that respect axial relates to the bore axis.

In addition it can be advantageous if arranged axially between the two elastic elements is a spacer sleeve which embraces the fixing portion.

As an alternative thereto it is also possible for the fixing portion to have two axially spaced recesses, for example peripherally extending grooves, in which the two elastic elements are at least partially arranged.

In a further preferred embodiment the component has a pressure element which is moveable relative to the fixing portion and which is so designed that a forced can be exerted therewith on the elastic element. By the application of the force to the elastic element the latter tries to escape and thus increases the force which the inside walls of the bore exert on the fixing portion of the component by way of the elastic element.

In a further preferred embodiment the pressure element is in the form of a sleeve with a female thread and the component has a portion with a male thread, on which the pressure element is arranged, wherein the pressure element is arranged at least portion-wise together with the fixing portion within the bore so that the pressure element can be moved further into the bore or out of the bore by rotation of the pressure element relative to the component.

If now the pressure element is rotated relative to the fixing portion so that it moves into the bore it will at some time meet the elastic element and compress it in a direction, whereby enlargement of the elastic element occurs in a direction which is substantially perpendicular to the direction of movement of the pressure element, whereby the component is fixedly clamped within the bore so that unwanted detachment is prevented even in the ultrasonic procedure.

Alternatively or in combination therewith the fixing portion can have a recess which is preferably in the form of a peripherally extending groove and in which the elastic element which is preferably an O-ring is arranged.

The component can be for example a compressed air feed means. In that case the component is tubular, wherein provided at the outside of the tube is the fixing portion which is inserted into a corresponding bore in the vibration element, with the interposition of an elastic element. Alternatively air can also be sucked away by way of the component.

The described fixing method however can also be used at another location. For example there are sonotrodes having an annular sealing surface so that a hold-down means is wanted in the interior of the annular sealing surface. That hold-down means then has to be arranged in the interior of the sonotrode. The sonotrode thus has a cavity and the component, more specifically a mounting means for a corresponding hold-down means, can then be arranged within the cavity. Actuation of the hold-down means can be effected for example by means of compressed air which is also supplied through the arrangement according to the invention. Instead of the hold-down means it would also be possible to fix a damper or a suction device in the interior of the sonotrode.

Further advantages, features and possible uses will be apparent from the description hereinafter of preferred embodiments and the accompanying Figures in which.

Figure 3:
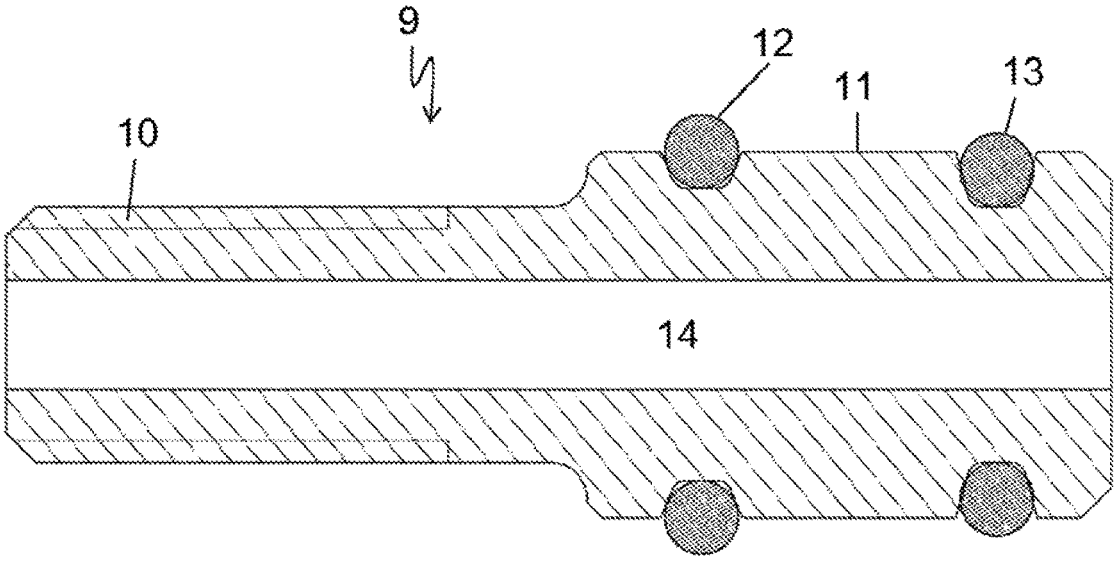
Figure 4:
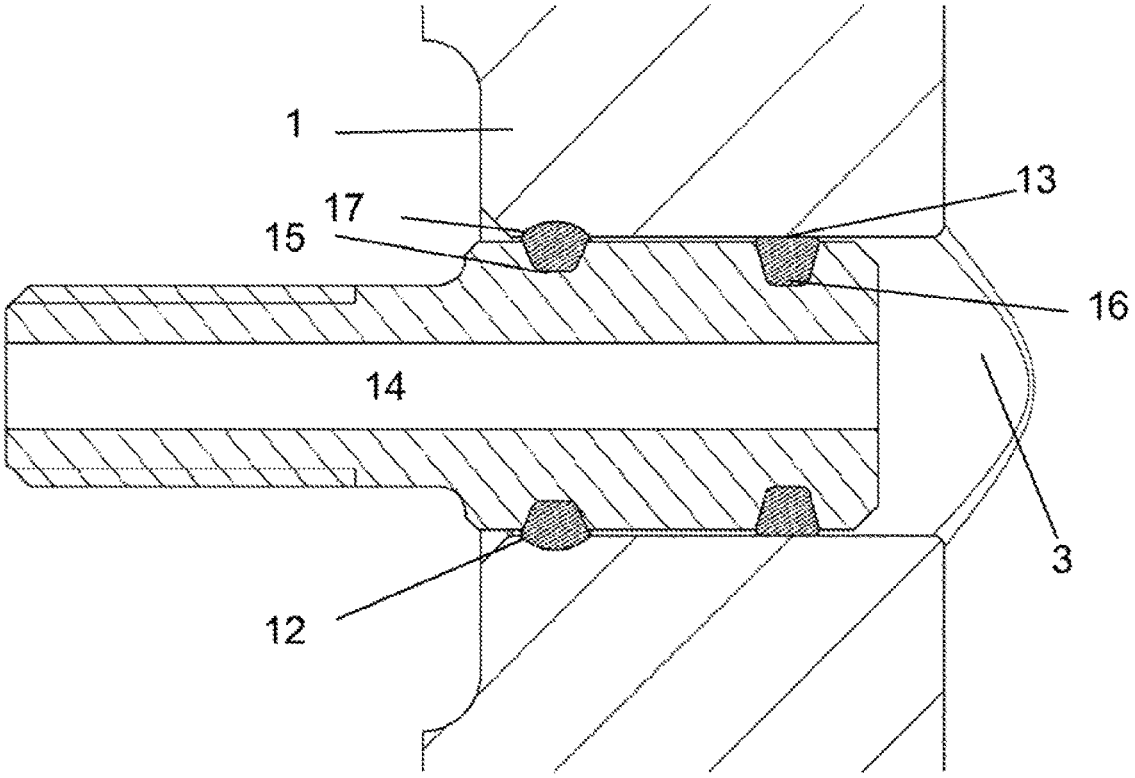
Figure 5:
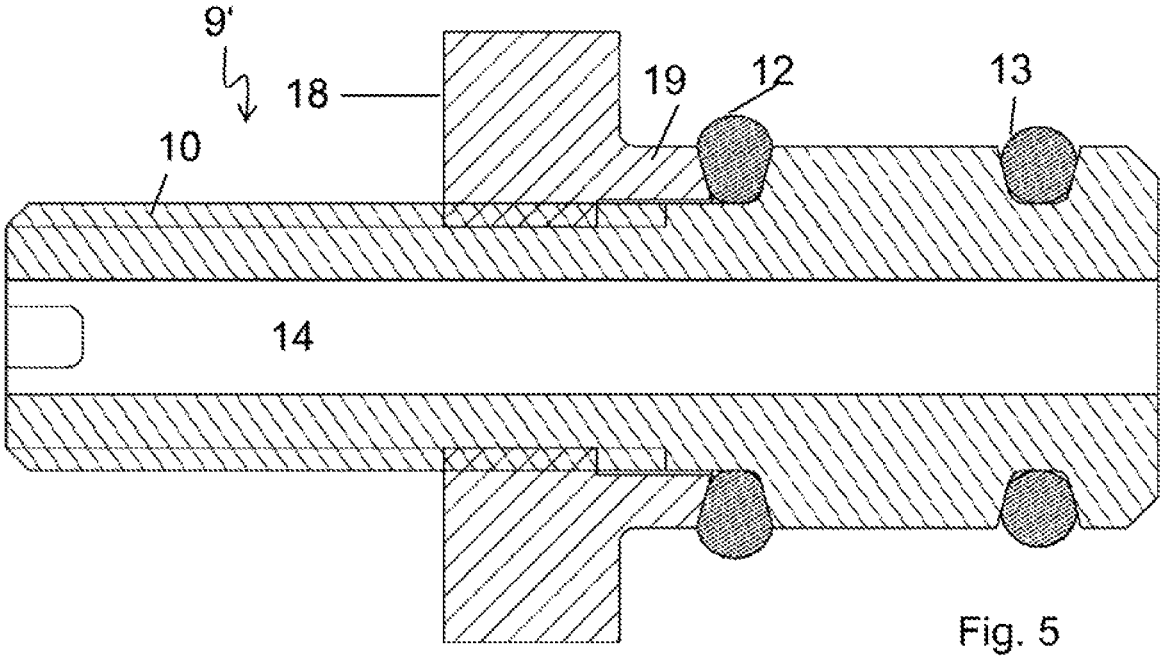
Figure 6:
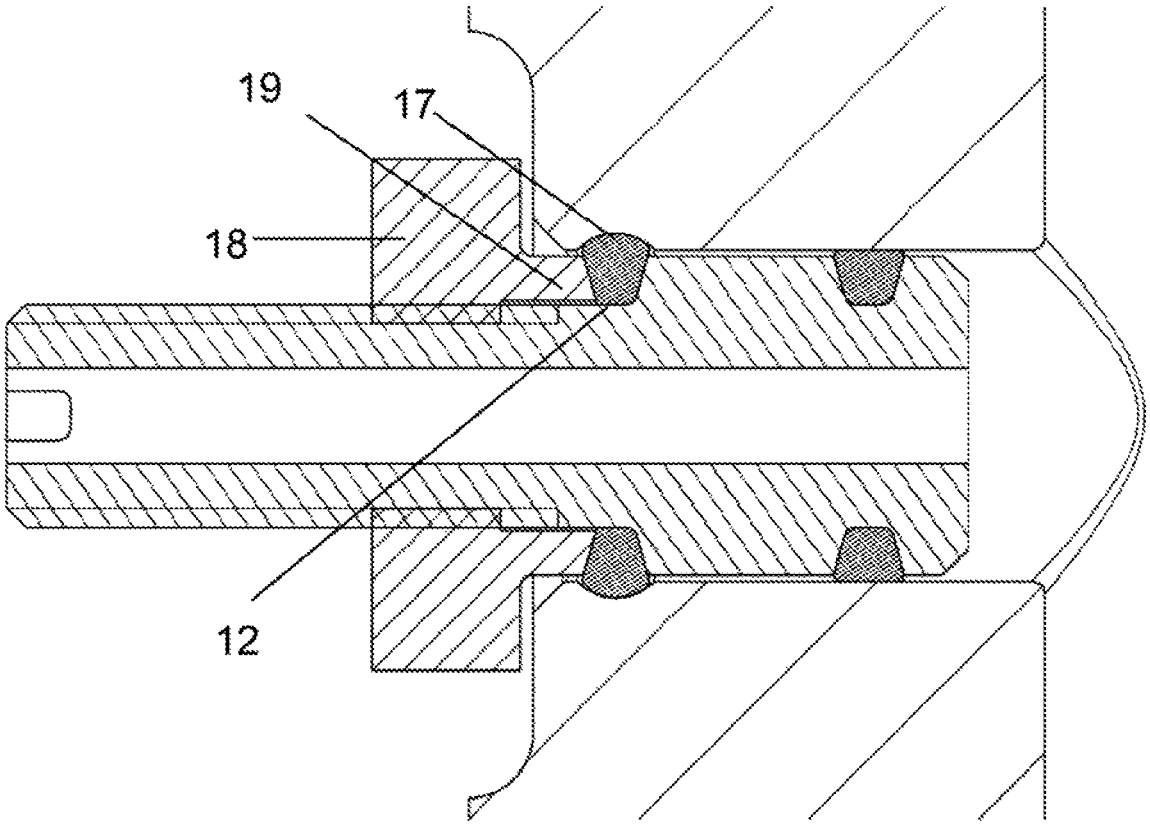
Figure 7:
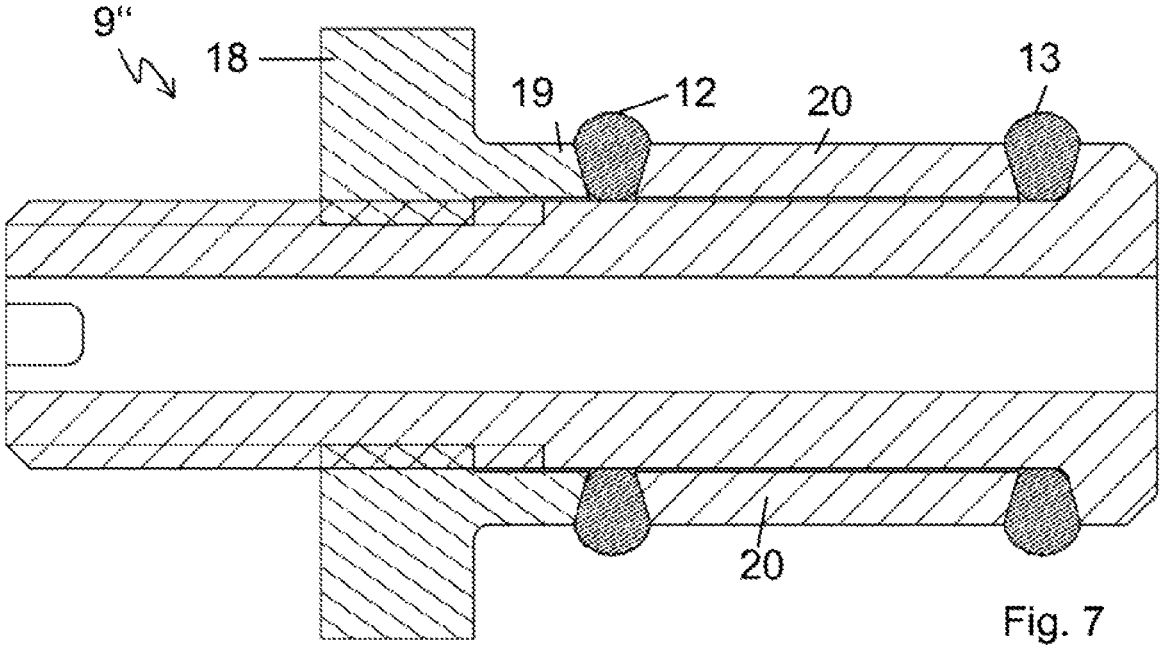
Figure 8:
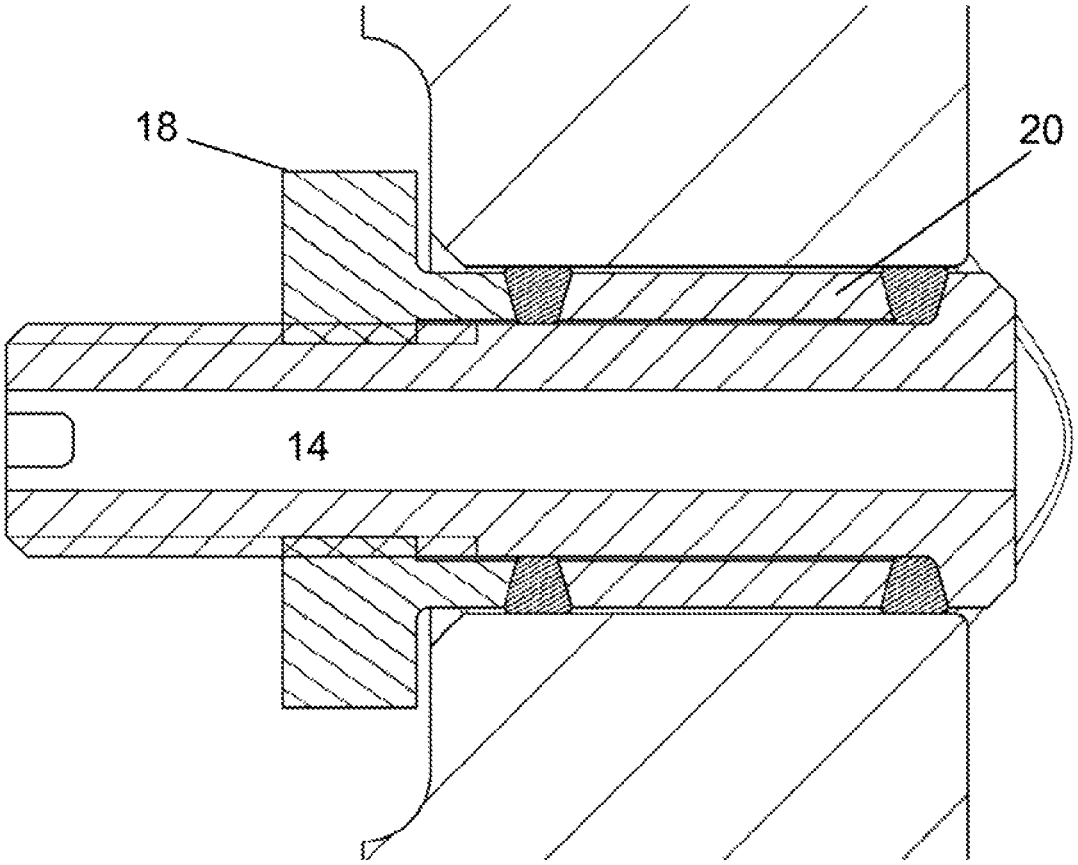
Figure 9:
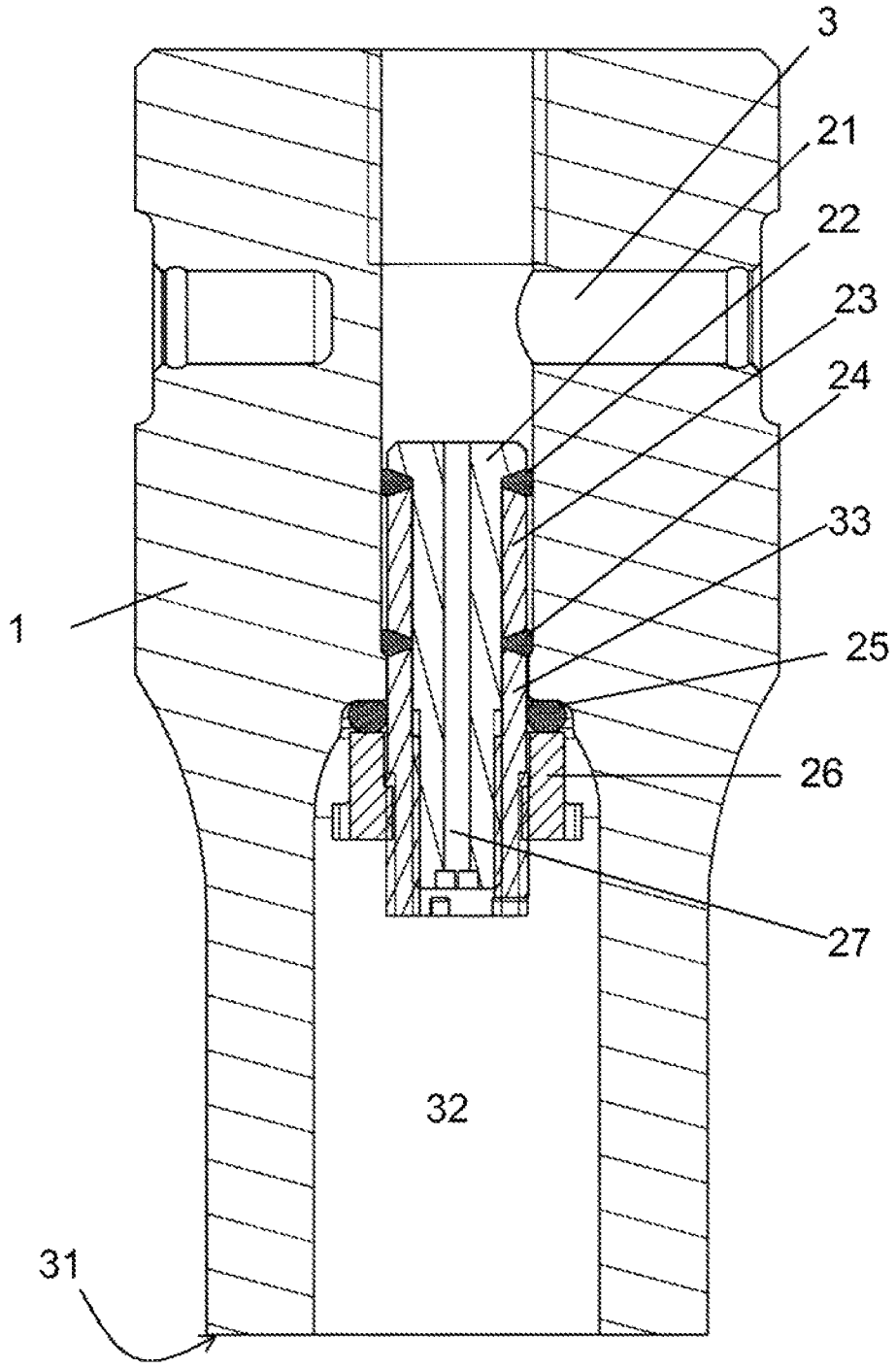
Figure 10:
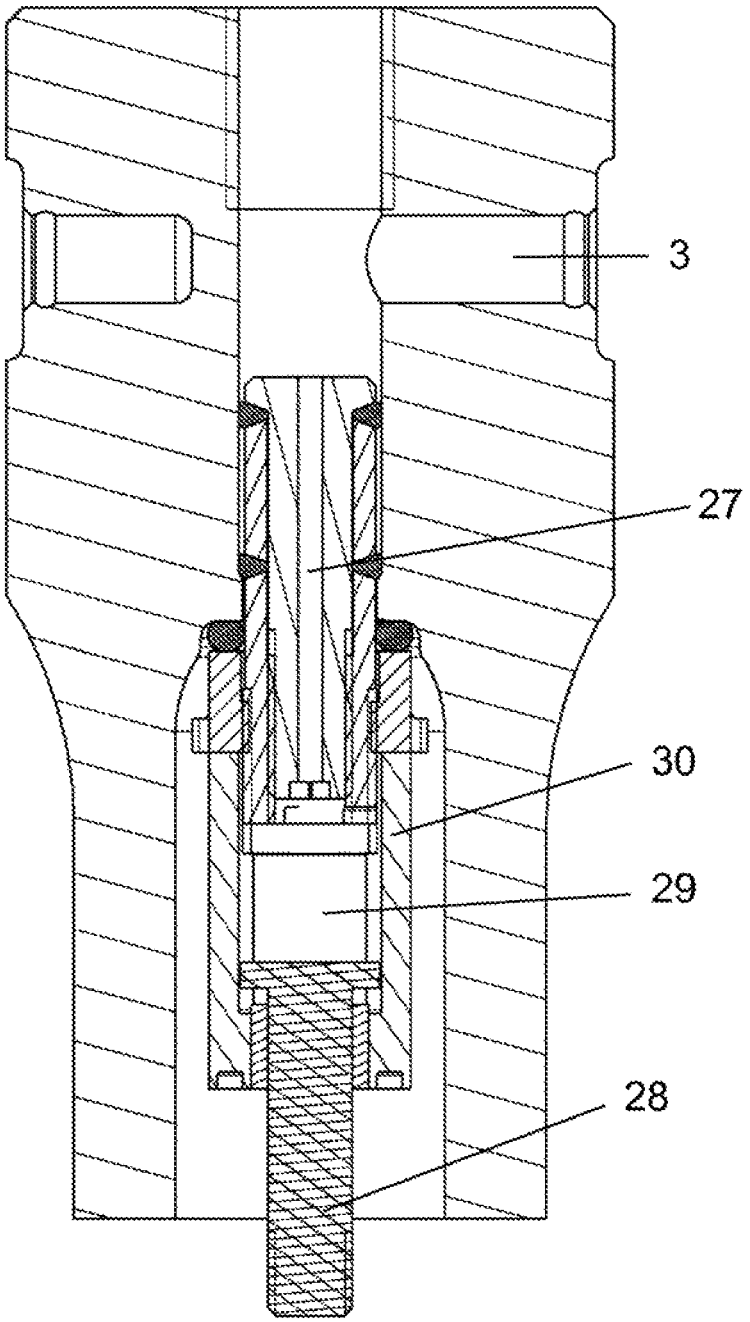

FIG. 3 shows a cross-sectional view of a component of a first embodiment according to the invention, FIG. 4 shows a partial cross-sectional view of the vibration element with fitted component of the first embodiment of the invention, FIG. 5 shows a cross-sectional view of a component of a second embodiment of the invention, FIG. 6 shows a detail view of a cross-section of a vibration element with fitted component according to the second embodiment of the invention, FIG. 7 shows a cross-sectional view of a component of a third embodiment of the invention, FIG. 8 shows a detail view of a cross-section of a vibration element with fitted component according to the third embodiment of the invention, FIG. 9 shows a cross-section through a vibration element according to the fourth embodiment of the invention, and FIG. 10 shows a cross-sectional view as shown in FIG. 9 but additionally with air pressure-operated hold-down means.

Figure 1:
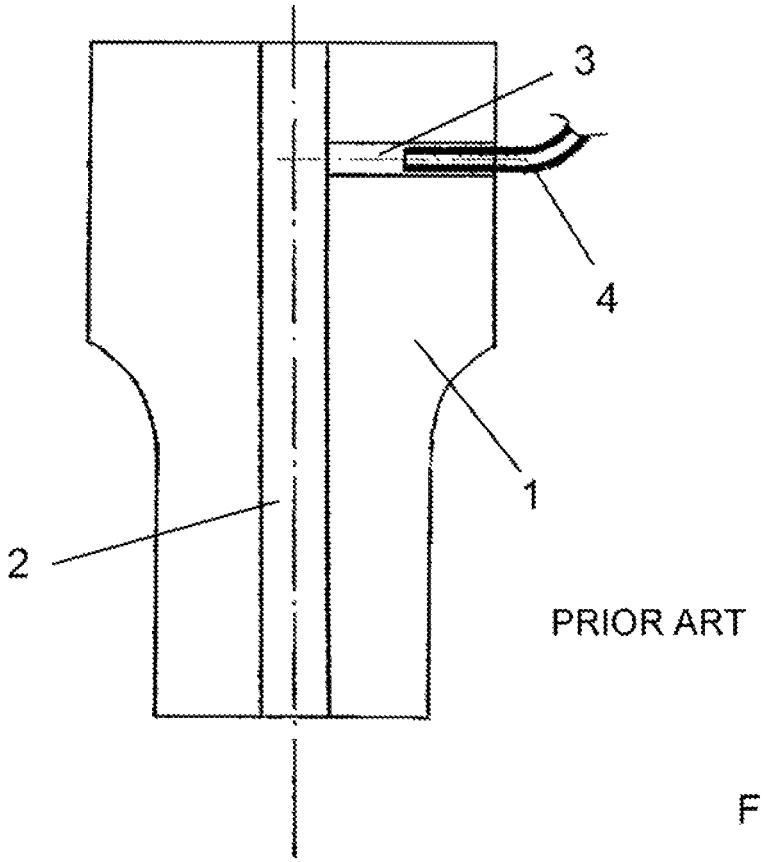
FIG. 1 shows a first embodiment of the state of the art.
Figure 2:
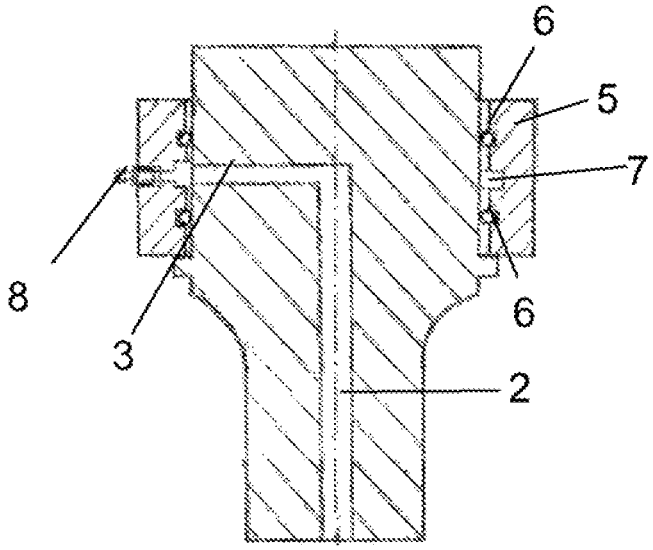
FIG. 2 shows a second embodiment of the state of the art.

FIGS. 1 and 2 show two embodiments of the state of the art, which have already been described above.

FIG. 3 shows a cross-sectional view of a component of a first embodiment of the invention. The component 9 is substantially tubular with a central passage 14. The component 9 has a fixing portion 11 and a thread portion 10. A suitable hose for supplying compressed air can be fitted to the thread portion 10. The fixing portion 11 has two O-rings 12, 13 arranged in suitable grooves 15, 16.

FIG. 4 shows a detail view showing the interplay between the component 9 on the one hand and the vibration element 1 on the other hand. The vibration element 1, for example a sonotrode, has a bore 3. The fixing portion 11 is fitted together with the two O-rings 12, 13 into the bore 3. In order to securely hold the component 9 in the bore 3 the inside wall of the bore 3 is provided with a groove 17 in which the O-ring 12 is held. The two grooves 15, 16 on the fixing portion 11 for receiving the two O-rings 12 and 13 are of differing groove depth, as can be clearly seen from FIGS. 3 and 4. In that respect account has been taken of the fact that the O-ring 12 finds a corresponding groove 17 on the vibration element 1 while that is not the case with the second O-ring 13. In order to keep the distribution of force between the two O-rings substantially equal therefore the depth of the groove 16 is such that it corresponds to the total of the groove depths of the groove of smaller depth 15 in the component 9 and the depth of the groove 17 in the vibration element.

In the condition shown in FIG. 4 the component is matched in substantially vibration-decoupled relationship within the vibration element 1. Unwanted displacement of the component 9 within the bore 3 is prevented by the O-ring 12 engaging both into a recess 15 in the component 9 and also into a recess 17 in the vibration element 1.

FIG. 5 shows a sectional view of a second embodiment according to the invention. As far as possible the same references have been used to denote the same elements.

The embodiment of the component shown in FIG. 5 essentially differs from the embodiment shown in FIG. 3 in that on the one hand the groove depth for the two O-rings 12, 13 is the same. Furthermore the component 9' here additionally has a pressure element 18 which is mounted by means of a female thread to the male thread 10 of the thread portion. The pressure element 18 can be moved in the axial direction towards the O-ring 12 and away from same by relative rotation of the pressure element 18 with respect to the component 9'.

The pressure element 18 is of a sleeve-shaped configuration and has an axially projecting neck portion 19 which comes into contact with the O-ring 12 towards the pressure element 18. For that purpose the neck portion is of an outside diameter which is smaller than the inside diameter of the bore. The groove for receiving the O-ring 12 is thus formed both by the component 9' and also by the pressure element 18 or the projecting collar element 19. FIG. 6 shows a detail view illustrating the cooperation of the component 9' with the vibration element 1. Here too the vibration element 1 has a bore 3 in which there is a peripherally extending groove 17 for receiving the O-ring 12.

To ensure in this embodiment that the two O-rings 12, 13 exert substantially comparable forces on the inside surfaces of the bore 3 of the vibration element 1 the pressure element 18 in the illustrated situation is rotated relative to the thread portion 10 in order to reduce the groove width in which the O-ring 12 is inserted, whereby the O-ring 12 is deformed and expands in the radial direction, which in turn means that the O-ring comes into contact with the bottom of the groove 17 in the vibration element 1. The O-ring 12 is pressed against the groove 17 by the pressure element 18 so as to ensure in operation that the component 9' can be moved in the axial direction neither in the direction of the sonotrode nor away from same.

FIG. 7 shows a component 9" of a third embodiment of the invention. Unlike the component 9' shown in FIG. 5, here there is a spacer sleeve 20. If now the pressure element 19 is rotated relative to the thread portion 10 the pressure element 18 moves in the direction towards the first O-ring 12 so that the latter is clamped between the neck portion 19 of the pressure element 18 and the spacer sleeve 20. As the spacer sleeve 20 is also arranged moveably it is moved in the direction of the second O-ring 13 so that a force can be exerted both on the first O-ring 12 and also on the second O-ring 13 by means of the pressure element 18.

As can be seen from FIG. 8 which shows the inserted condition, it is possible in this embodiment to dispense with the provision of a groove in the inside wall of the bore. In this case, by virtue of uniform application of the pressure force of the pressure element 18 to the two O-rings, a uniform application of force is ensured in this case by way of the two O-rings 12 and 13, even without the provision of a groove. It will be appreciated that one or more grooves can also be provided in this embodiment, into which an O-ring or both O-rings engages or engage.

FIG. 9 shows a cross-sectional view of a fourth embodiment. Here the sonotrode 1 has a substantially annular welding surface 31 which comes into contact with the material to be processed, in the ultrasonic processing procedure. A cavity 32 is therefore provided in the interior of the sonotrode. Depending on the respective situation of use it may be helpful if, while the annular welding surface 31 comes into contact with the material to be processed, a hold-down means presses the material downwardly within the annular welding surface. That hold-down means can also be fixed in vibration-decoupled relationship to the sonotrode 1.

For clarification purposes FIG. 9 shows only a sleeve 21 with an inner passage 27, mounted in vibration-decoupled relationship within the sonotrode 1. That sleeve 21 is arranged within a second sleeve 33 and connected thereto by way of a screw connection. In addition there are two O-rings 22 and 24 and a spacer sleeve 23. If now the sleeve 21 is rotated relative to the second sleeve 33 the result of this is that the projecting portion of the sleeve 21 presses the O-ring 22 against the spacer sleeve 23, whereupon the latter in turn exerts a force on the second O-ring 24. In that way the two O-rings are deformed so that they expand in the radial direction and clamp the sleeve 21 within the sonotrode 1. The longitudinal bore in the sonotrode is stepped so that the O-ring 24 comes to lie against the step in the bore, whereby movement of the sleeve downwardly, that is to say in the direction of the sealing surfaces 31, is prevented.

To prevent a movement in the opposite direction there is a further pressure element 26 having a female thread which is in engagement with a male thread on the second sleeve 33 and thus elastically deforms a third O-ring 25, which in turn provides that the connection cannot move axially upwardly.

FIG. 10 now also additionally shows that the second sleeve 33 is connected to a housing 30, the bottom of which is closed by means of a piston 28 which can be resiliently biased. A cavity 29 is thus formed in the housing 30 so that now, by means of compressed air which is supplied by way of the bore 3 and passed into the cavity 29 by way of the passage 27, force is applied to the piston 28 so that it is moved axially downwardly and can correspondingly hold the material to be processed.

The measure according to the invention makes it possible to provide for a vibration-decoupled connection of components to vibration elements.

LIST OF REFERENCES

1 sonotrode
2, 29, 32 cavity
3 bore
4 hose
5 suction ring
6, 12, 13, 22, 24, 25 O-rings
7 annular recess
8 connecting portion
9, 9', 9" component
10 thread portion
11 fixing portion
14, 27 passage
15, 16, 17 grooves
18, 26 pressure element
19 collar element
20, 23 spacer sleeve
21, 33 sleeve
28 piston
30 housing
31 welding surface

The invention claimed is:

1. A sonotrode vibrating during operation with a component fixed thereto, characterised in that the sonotrode has a bore and the component has a fixing portion fitted in the bore, wherein arranged between the fixing portion and the bore is at least one elastic element which is elastically deformed.

2. A sonotrode as set forth in claim 1 characterised in that the bore is of a circular cross-section.

3. A sonotrode as set forth in claim 1 characterised in that the fixing portion is of a circular cross-section.

4. A sonotrode as set forth in claim 1 characterised in that the at least one elastic element is arranged to completely surround the fixing portion.

5. A sonotrode as set forth in claim 4 characterised in that at least two elastic elements are arranged between the fixing portion and the bore, wherein preferably the two elastic elements are axially spaced from each other.

6. A sonotrode as set forth in claim 5 characterised in that arranged axially between the two elastic elements is a spacer sleeve which embraces the fixing portion.

7. A sonotrode as set forth in claim 1 characterised in that the component has a pressure element which is moveable relative to the fixing portion and which is so designed that a force can be exerted therewith on the elastic element.

8. A sonotrode as set forth in claim 1 characterised in that the fixing portion has a recess which is in the form of a peripherally extending groove and in which the at least one elastic element which is an O-ring is arranged.

9. A sonotrode as set forth in claim 1 characterised in that the component is an air feed or air discharge means.

10. A sonotrode as set forth in claim 1 characterised in that the sonotrode has a cavity and the component is arranged within the cavity, wherein the component is a hold-down means, damper or suction means.

11. A sonotrode according to claim 1 wherein the at least one elastic element is deformed parallel to the bore axis.

12. A sonotrode as set forth in claim 3 characterised in that at least two elastic elements are arranged between the fixing portion and the bore, wherein preferably the two elastic elements are axially spaced from each other.

13. A sonotrode as set forth in claim 12 characterised in that arranged axially between the two elastic elements is a spacer sleeve which embraces the fixing portion.

14. A sonotrode as set forth in claim 1 characterised in that the fixing portion has a recess which is preferably in the form of a peripherally extending groove and in which the at least one elastic element is arranged.

15. A vibration element with a component fixed thereto, characterised in that the vibration element has a bore and the component has a fixing portion fitted in the bore, wherein arranged between the fixing portion and the bore is at least one elastic element which is elastically deformed, characterised in that the component has a pressure element which is moveable relative to the fixing portion and which is so designed that a force can be exerted therewith on the elastic element, and further characterised in that the pressure element is in the form of a sleeve with a female thread and the component has a portion with a male thread, on which the pressure element is arranged, wherein the pressure element is arranged at least portion-wise together with the fixing portion within the bore so that the pressure element can be moved further into the bore or out of the bore by rotation of the pressure element relative to the component.

16. A sonotrode vibrating during operation with a component fixed thereto, characterised in that the sonotrode has a bore having an inside surface and the component has a fixing portion fitted in the bore, wherein arranged between the fixing portion and the bore is at least one elastic element which is arranged at least partially within a recess provided in the inside surface of the bore in such a way that the component can be removed from the bore only by elastic deformation of the elastic element.

17. A sonotrode as set forth in claim 16 characterised in that the bore and the fixing portion are of a circular cross-section, and the at least one elastic element is arranged to completely surround the fixing portion.

18. A sonotrode as set forth in claim 16 characterised in that the component has a pressure element which is moveable relative to the fixing portion and which is so designed that a force can be exerted therewith on the elastic element.

19. A sonotrode as set forth in claim 16 characterised in that the component is an air feed or air discharge means, and in that the sonotrode has a cavity and the component is arranged within the cavity, wherein the component is a hold-down means, damper or suction means.

20. A vibration element with a component fixed thereto, characterised in that the vibration element has a bore having an inside surface and the component has a fixing portion fitted in the bore, wherein arranged between the fixing portion and the bore is at least one elastic element which is arranged at least partially within a recess provided in the inside surface of the bore in such a way that the component can be removed from the bore only by elastic deformation of the elastic element;

characterised in that the component has a pressure element which is moveable relative to the fixing portion and which is so designed that a force can be exerted therewith on the elastic element; and further characterised in that the pressure element is in the form of a sleeve with a female thread and the component has a portion with a male thread, on which the pressure element is arranged, wherein preferably the pressure element is arranged at least portion-wise together with the fixing portion within the bore so that the pressure element can be moved further into the bore or out of the bore by rotation of the pressure element relative to the component.

* * * * *